US008216653B2

(12) United States Patent
Liao et al.

(10) Patent No.: US 8,216,653 B2
(45) Date of Patent: Jul. 10, 2012

(54) PROTECTING FILM AND METHOD FOR COATING PROTECTING FILM ON WORKPIECE

(75) Inventors: Qian-Long Liao, Shenzhen (CN); Xiao-Ying Cheng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 604 days.

(21) Appl. No.: 12/249,844

(22) Filed: Oct. 10, 2008

(65) Prior Publication Data

US 2009/0280283 A1 Nov. 12, 2009

(30) Foreign Application Priority Data

May 9, 2008 (CN) ..... 2008 1 0301525

(51) Int. Cl.
*B32B 3/16* (2006.01)
*B05D 3/12* (2006.01)

(52) U.S. Cl. ..... 428/42.2; 428/40.1; 428/41.7; 428/41.8; 428/136; 428/195.1; 428/201; 428/202

(58) Field of Classification Search ..... None
See application file for complete search history.

(56) References Cited

U.S. PATENT DOCUMENTS

| | | | | |
|---|---|---|---|---|
| 4,032,679 | A * | 6/1977 | Aoyagi | 428/42.3 |
| 4,549,750 | A * | 10/1985 | Stone et al. | 283/79 |
| 5,658,632 | A * | 8/1997 | Krabill | 428/43 |
| 2006/0062953 | A1 * | 3/2006 | Trigg et al. | 428/40.1 |

FOREIGN PATENT DOCUMENTS

JP 2002019333 A * 1/2002

OTHER PUBLICATIONS

English Abstract for JP 2002019333 A, Jan. 2002.*

* cited by examiner

*Primary Examiner* — David Sample
*Assistant Examiner* — Jeff Vonch
(74) *Attorney, Agent, or Firm* — Altis Law Group, Inc.

(57) ABSTRACT

An exemplary protecting film for coating a three-dimensional surface of a workpiece, includes an adhesive layer and a release layer. The adhesive layer defines a split. The release layer includes a remaining portion for shielding the split of the adhesive layer and a release portion detachably formed on the adhesive layer. The remaining portion is capable of remaining on the adhesive layer after the release portion detaches from the adhesive layer. A method for coating a protecting film on a workpiece is also provided.

4 Claims, 5 Drawing Sheets

PROTECTING FILM AND METHOD FOR COATING PROTECTING FILM ON WORKPIECE

BACKGROUND

1. Technical Field

The present disclosure generally relates to a protecting film and a method for coating a protecting film on a workpiece.

2. Description of the Related Art

After a workpiece has been machined, a protecting film is generally coated on a surface of the workpiece for protecting the surface. Since the protecting film is generally a flat film, air bubbles/pockets tend to develop on a three-dimensional surface portion of the workpiece.

A typical protecting film generally includes an adhesive layer and a release layer formed on the adhesive layer. The adhesive layer defines a plurality of splits to separate the adhesive layer into a plurality of sections. In use, the release layer is detached from the adhesive layer, and the adhesive layer is then coated on the three-dimensional surface portion of the workpiece. The adhesive layer is capable of reducing air bubbles from the splits. However, a portion of the adhesive layer adjacent to the splits is easily damaged when forming the splits. When the adhesive layer is coated on the three-dimensional surface portion of the workpiece, a portion of the adhesive layer adjacent to the splits may detach from the adhesive layer and remain on the three-dimensional surface portion of the workpiece. Therefore, a plurality of adhesive trails may be formed on the three-dimensional surface portion of the workpiece, and the adhesive trails may unduly decrease a surface quality of the workpiece.

Therefore, a new protecting film and a method for coating a protecting film on a workpiece are desired to overcome the above-described shortcomings.

SUMMARY

A protecting film for coating a three-dimensional surface of a workpiece, includes an adhesive layer and a release layer. The adhesive layer defines a split. The release layer includes a remaining portion for shielding the split of the adhesive layer and a release portion detachably formed on the adhesive layer. The remaining portion is capable of remaining on the adhesive layer after the release portion detaches from the adhesive layer.

A method for coating a protecting film on a workpiece, includes providing a workpiece having a three-dimensional surface and a protecting film including an adhesive layer and a release layer including a remaining portion and a release portion, the adhesive layer defining a split, detaching the release portion of the release layer from the adhesive layer and with the remaining portion remaining on the adhesive layer for shielding the split, and coating the adhesive layer together with the remaining portion on the three-dimension surface.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present protecting film. Moreover, in the drawings, like reference numerals designate corresponding parts throughout the several views.

DETAILED DESCRIPTION

Figure 1:
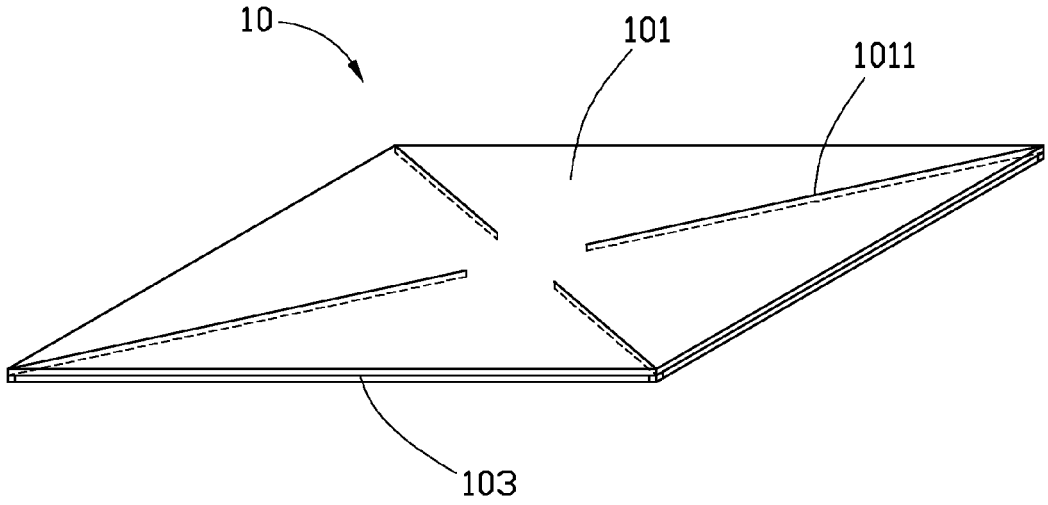
FIG. 1 is a schematic, isometric view of an embodiment of a protecting film, the protecting film including an adhesive layer and a release layer.

Referring to FIG. 1, one embodiment of a protecting film 10, includes an adhesive layer 101 and a release layer 103. The adhesive layer 101 is removably attached to the release layer 103. In the embodiment of FIG. 1, the adhesive layer 101 and the release layer 103 are rectangular shaped.

The adhesive layer 101 defines four splits 1011 in two diagonals of the adhesive layer 101, and each pair of splits 1011 are defined in opposite ends of one diagonal, thereby separating the adhesive layer 101 into four sections. Each split 1011 of the adhesive layer 101 is capable of being expanded in a width direction. The four sections are connected to one another in a middle portion of the adhesive layer 101.

Figure 2:
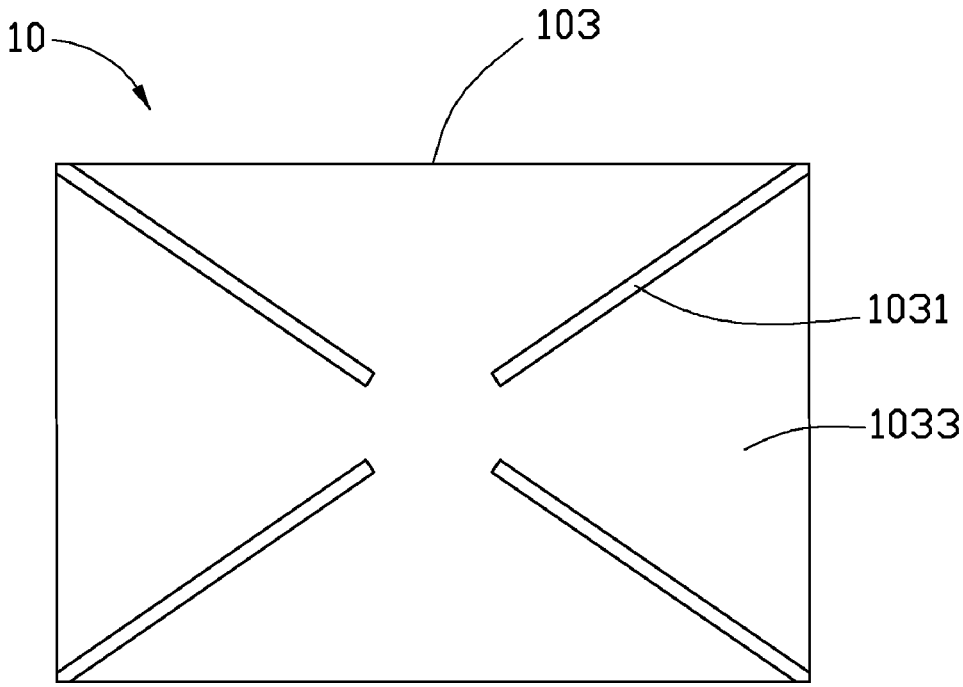
FIG. 2 is a bottom view of the protecting film of FIG. 1

Referring also to FIG. 2, the release layer 103 includes four remaining portions 1031 and a release portion 1033. The remaining portions 1031 are positioned on the splits 1011 for shielding the splits 1011. The release portion 1033 is detachably formed on the adhesive layer 101. The remaining portions 1031 are capable of remaining on the adhesive layer 10 after the release portion 1033 detaches from the adhesive layer 101. In the embodiment of FIG. 1, a length of each split 1011 is substantially equal to a length of each remaining portion 1031. Each remaining portion 1031 has a same width.

Figure 5:
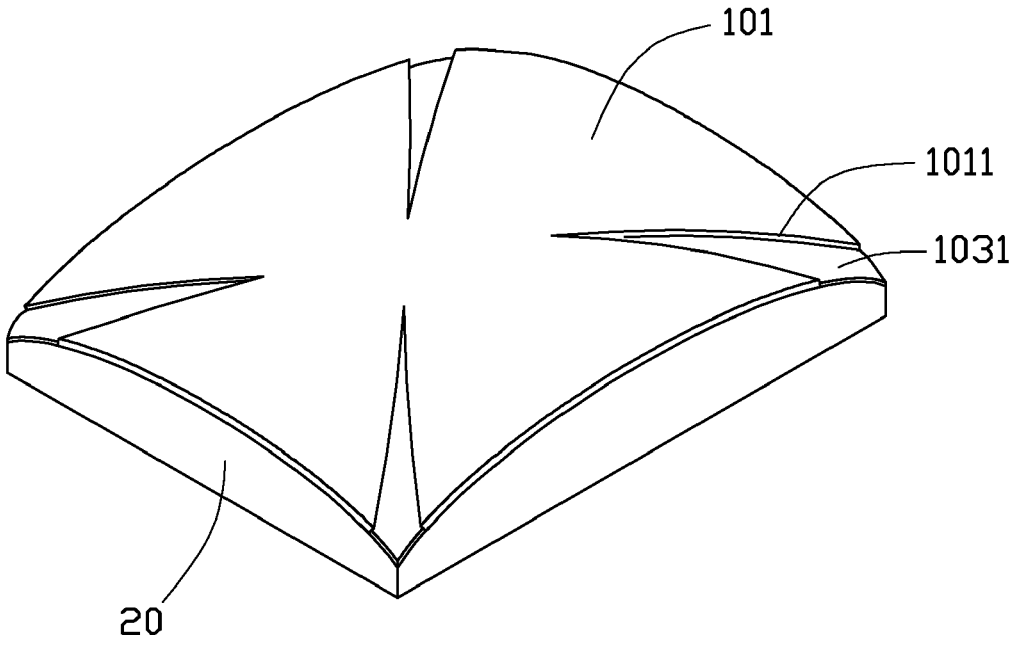
FIG. 5 is an isometric view of the protecting film of FIG. 1 adhered to the workpiece of FIG. 1.

Referring to FIG. 5, opposite sides of each split 1011 of the adhesive layer 101 are capable of moving away from each other, that is, a width of each split is expandable. A maximum width between the opposite sides of each split 1011 of the adhesive layer 101 is less than the width of each remaining portion 1031.

Figure 3:
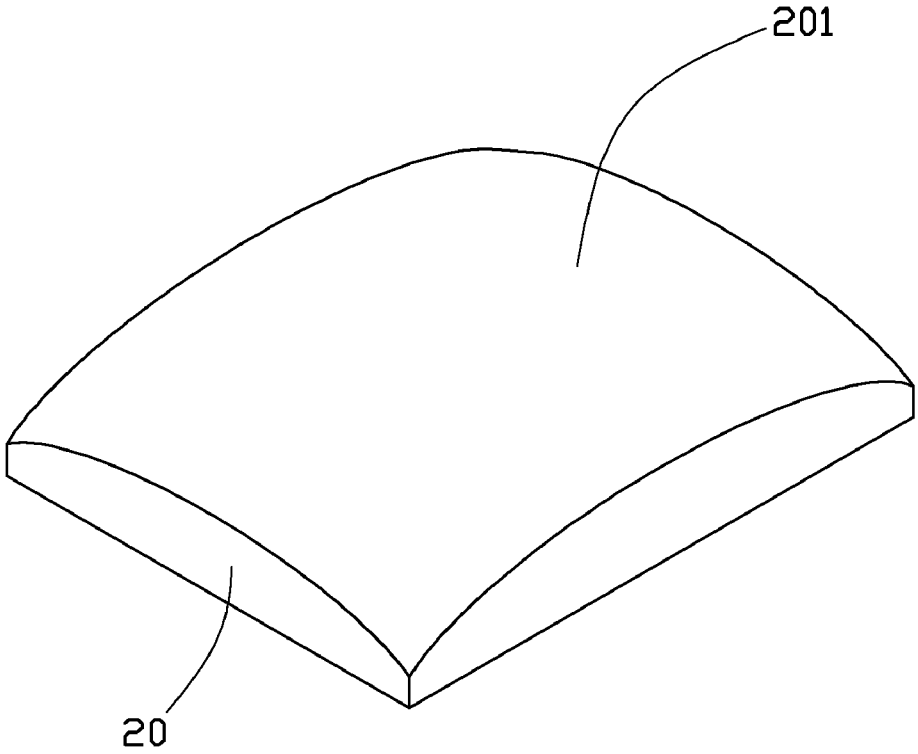
FIG. 3 is an isometric view of a workpiece using the protecting film of FIG. 1.
Figure 4:
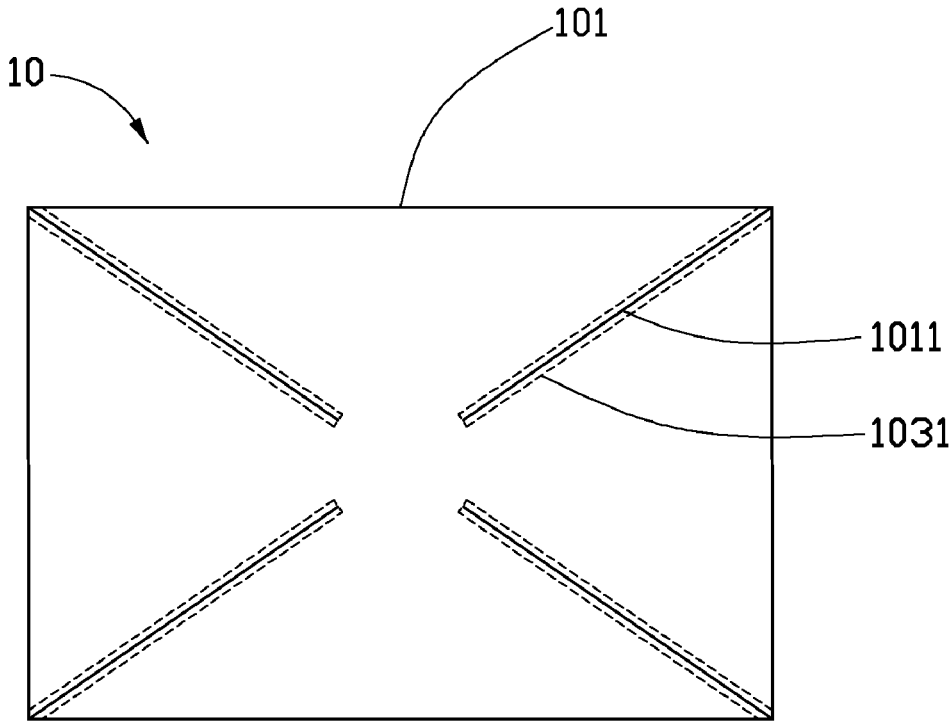
FIG. 4 is a top view of the protecting film of FIG. 1, and showing a release portion of the release layer detached from the protecting film.

Referring to FIGS. 3 through 5, an embodiment of a method for coating a protecting film on a workpiece includes the steps described below. Depending on the embodiment, certain of the steps described below may be removed, others may be added, and the sequence of steps may be altered.

A workpiece 20 and the protecting film 10 are provided. The workpiece 20 includes a three-dimensional surface 201. In the embodiment of FIG. 3, the three-dimensional surface 201 is a curved surface. The release portion 1033 of the release layer 103 is detached from the adhesive layer 101. The remaining portions 1031 remain on the adhesive layer 101 for shielding the splits 1011 of the adhesive layer 101. The adhesive layer 101 together with the remaining portions 1031 is coated on the three-dimensional surface 201. The remaining portions 1031 of the release layer 103 are positioned between the adhesive layer 101 and the three-dimensional surface 201 of the workpiece 20 when the protecting film 10 is coated on the workpiece 20.

In use, the remaining portions 1031 remain on the adhesive layer 101 for shielding the splits 1011 of the adhesive layer 101, thus adhesive displaced from a portion of the adhesive layer 101 adjacent to the splits 1011 can be retained by the remaining portions 1031. Therefore, the remaining portions

1031 are capable of preventing the three-dimensional surface 201 of the workpiece 20 from contamination by the adhesive trails.

The protecting film 10 is configured for protecting the three-dimensional surface 201 of the workpiece 20 until the protecting film 10 is removed from the three-dimensional surface 201 of the workpiece 20. Thus, a stickiness character of the adhesive layer 101 should be relatively poor. Since the stickiness character of the adhesive layer 101 is relatively poor, opposite sides of each split 1011 of the adhesive layer 101 can be displaced away from each other. Therefore, the adhesive layer 101 can be uniformly coated on the three-dimensional surface 201 of the workpiece 20. Since the maximum width between the opposite sides of each split 1011 of the adhesive layer 101 is less than a width of each remaining portion 1031, the remaining portions 1031 are capable of retaining the adhesive detached from a portion of the adhesive layer 101 adjacent to the splits 1011.

It should be pointed out, a number of the splits 1011 is not limited to four and can be changed according to a shape of the three-dimensional surface 201 of the workpiece 20. A shape and a number of each of the remaining portions 1031 may be changed according to the splits 1011.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the disclosure.

What is claimed is:

1. A protecting film coating a three-dimensional surface of a workpiece, comprising:

an adhesive layer defining at least one split; and a release layer comprising at least one remaining portion for shielding the at least one split of the adhesive layer and a release portion detachably formed on the adhesive layer, the at least one remaining portion being capable of remaining on the adhesive layer after the release portion detaches from the adhesive layer;

wherein the at least one split of the adhesive layer are capable of being expanded in a width direction, and a maximum width between the opposite sides of each split of the adhesive layer is less than a width of the at least one remaining portion, such that the adhesive layer is adhered to the three-dimensional surface of the workpiece with the at least one split being expanded in a width direction, the at least one remaining portion is positioned between the adhesive layer and the three-dimensional surface of the workpiece and remains on the adhesive layer for shielding the splits of the adhesive layer.

2. The protecting film of claim 1, wherein the adhesive layer and the release layer are rectangular shaped.

3. The protecting film of claim 2, wherein the at least one split comprises four splits defined in two diagonals of the adhesive layer, each pair of splits are defined in opposite ends of one diagonal, thereby separating the adhesive layer into four sections;

and the at least one remaining portion comprises four remaining portions, and each remaining portion shields one corresponding split of the adhesive layer.

4. The protecting film of claim 2, wherein the at least one split is expanded in a width direction to form a triangular split.

* * * * *